US006273158B1

(12) United States Patent
Sharpe

(10) Patent No.: US 6,273,158 B1
(45) Date of Patent: Aug. 14, 2001

(54) PROTECTIVE COVER FOR A GOLF BAG

(76) Inventor: Raymond P. Sharpe, Five Sparrow La., East Greenwich, RI (US) 02818

( * ) Notice: Subject to any disclaimer, the term of this patent is extended or adjusted under 35 U.S.C. 154(b) by 0 days.

(21) Appl. No.: 09/103,092

(22) Filed: Jun. 23, 1998

(51) Int. Cl.[7] ..... B65D 65/02; A63B 55/00

(52) U.S. Cl. ..... 150/159; 206/315.3; 206/315.4; 224/601

(58) Field of Search ..... 224/601, 314, 224/613, 614; 206/315.4, 315.3; 150/159

(56) References Cited

U.S. PATENT DOCUMENTS

| | | | | |
|---|---|---|---|---|
| 1,119,508 | * | 12/1914 | Headley | 206/315.4 |
| 1,570,510 | * | 1/1926 | McQuirk | 206/315.4 |
| 1,795,880 | * | 3/1931 | Mullins | 206/315.4 |
| 2,256,521 | * | 9/1941 | Kirkpatrick et al. | 206/315.4 |
| 2,627,996 | * | 2/1953 | Dorner | 220/212.5 |
| 2,704,563 | | 3/1955 | Henrich . | |
| 2,718,251 | | 9/1955 | Barbato . | |
| 2,780,399 | * | 2/1957 | Long | 224/601 X |
| 3,059,681 | | 10/1962 | Lorbeski . | |
| 3,288,189 | * | 11/1966 | Davis | 206/315.4 |
| 3,316,951 | * | 5/1967 | Jacobson | 150/315.4 |
| 3,530,919 | * | 9/1970 | May | 206/315.4 |
| 4,453,632 | * | 6/1984 | Clower | 150/159 X |
| 4,674,787 | * | 6/1987 | DeVera | 150/154 X |
| 4,796,752 | * | 1/1989 | Reimers | 206/315.3 |
| 4,953,768 | * | 9/1990 | Muse | 150/159 |
| 5,005,623 | * | 4/1991 | Webster, Jr. | 206/315.4 X |
| 5,092,506 | | 3/1992 | Bolduc . | |
| 5,131,442 | * | 7/1992 | Bevier | 150/154 |
| 5,220,950 | | 6/1993 | Cordasco . | |
| 5,383,505 | * | 1/1995 | Cordasco, Jr. | 206/315.4 X |
| 5,439,153 | | 8/1995 | Murdoch et al. . | |
| 5,769,219 | * | 6/1998 | Shimel | 206/315.3 |
| 5,904,195 | * | 5/1999 | Doig | 206/315.4 X |
| 5,904,247 | * | 5/1999 | Voelkner, Jr. | 206/315.4 |

* cited by examiner

*Primary Examiner*—Allan N. Shoap
*Assistant Examiner*—Tri M. Mai
(74) *Attorney, Agent, or Firm*—Mintz, Levin, Cohn, Ferris, Glovsky and Popeo, P.C.

(57) ABSTRACT

A cover for a golf bag having a strap with strap sections that attach to the golf bag at two attachment points near a top opening of the golf bag is provided. The cover includes a housing having a top opening and a bottom opening, the bottom opening being constructed and arranged for mating with a top portion of the golf bag. The cover also includes a top section covering the top opening of the housing, and an attaching mechanism, mounted on the housing, that is constructed and arranged to secure the cover around the strap sections of the golf bag.

10 Claims, 3 Drawing Sheets

PROTECTIVE COVER FOR A GOLF BAG

FIELD OF THE INVENTION

The present invention relates generally to the sport of golf, and more particularly to a protective cover for a golf bag.

DISCUSSION OF THE RELATED ART

A typical golf bag 10 having an open top 12 to allow insertion and removal of golf clubs 13 is shown in FIG. 1. The golf bag 10 has a shoulder strap 14 that is used by a golfer or a golfer's caddy to carry the golf bag containing the golfer's clubs during a round of golf. In typical golf bags, the shoulder strap is attached to the bag using a four point system that provides connection of the shoulder strap to the bag at two upper locations, using two upper strap segments 16 and 18, and at two lower locations, using two lower strap segments 20 and 22. In other golf bags that use a four point system for the shoulder strap, the strap is comprised of two straps that extend from the top of the bag to the bottom of the bag to enable a golder to carry the bag using both shoulders. The straps may be independent of each other or be connected together in some manner. In some prior art golf bags the two lower strap segments connect to a common point on the bag.

Because of the popularity of golf and the difficulty in getting tee times, it is not unusual for a golfer to continue or to begin golfing in inclement weather. The typical golf bag 10 does not have a protective cover over the open top 12, and golf clubs and other contents of the golf bag may get wet when it rains during a round of golf. There are prior art devices that are intended to cover the open top of a golf bag. One such device is shown in U.S. Pat. No. 2,704,563 to Henrich. The device disclosed by Henrich has several drawbacks when used with the golf bag 10. First, it is not suitable for use with a golf bag having a four point shoulder strap, and second, it does not allow removal of golf clubs from the bag without removing the entire cover.

Another prior art device is shown in U.S. Pat. No. 5,220,950 to Cordasco. The device disclosed by Cordasco also has several drawbacks. First, the golf bag cover disclosed by Cordasco is intended to cover an entire golf bag, and is therefore relatively large. Because of its large size, it cannot be stowed easily in the golf bag to be readily accessible when needed. Second, the golf bag cover disclosed by Cordasco is not suitable for use with a golf bag having a four point shoulder strap.

It is desirable to provide a golf bag cover that overcomes the drawbacks of prior art devices discussed above.

SUMMARY OF THE INVENTION

Embodiments of the present invention overcome the drawbacks of the prior art golf bag covers described above by providing a cover for the top of a golf bag that is adapted for use with a four point shoulder strap.

A first aspect of the present invention is directed to a cover for a golf bag having a strap with strap sections that attach to the golf bag at two attachment points near a top opening of the golf bag. The cover includes a housing having a top opening and a bottom opening, the bottom opening being constructed and arranged for mating with a top portion of the golf bag. The cover further includes a top section covering the top opening of the housing, and an attaching mechanism, mounted on the housing, that is constructed and arranged to secure the cover around the strap sections of the golf bag.

In one version of the first aspect of the invention, the attaching mechanism includes a first strap having a first end coupled to the housing and having a second end that extends between the strap sections of the golf bag, and a second strap having a first attachment point to couple the second strap to the housing and a second attachment point that is constructed and arranged to couple to the second end of the first strap.

In another version of the first aspect, the second strap has a third attachment point to couple the second strap to a position on the housing different than that for the first attachment point.

In yet another version of the first aspect, the housing includes two U-shaped notches proximate the bottom opening to allow the cover to be placed over the strap sections.

In still another version, the top section is coupled to the housing to form a waterproof seam.

In yet another version, the top section includes a flap that is movable between an open position and a closed position, wherein in the open position, an opening is formed in the top section to enable a golf club to be removed from the golf bag when the cover is placed on the golf bag, and wherein in the closed position, the flap forms a seal over the opening.

A second aspect of the present invention is directed to a cover for a golf bag having a strap with strap sections that attach to the golf bag at two attachment points near a top opening of the golf bag. The cover includes a housing having a top opening and a bottom opening, the bottom opening being constructed and arranged for mating with a top portion of the golf bag. The cover further includes a top section covering the top opening of the housing, and means for securing the cover around the strap section of the golf bag.

In one version of the second aspect, the cover further includes means for opening a portion of the cover to allow a golf club to be removed from the golf bag when the cover is installed on the golf bag.

DESCRIPTION OF THE DRAWINGS

For a better understanding of the present invention, reference is made to the drawings which are incorporated herein by reference and in which.

DETAILED DESCRIPTION

Figure 1:
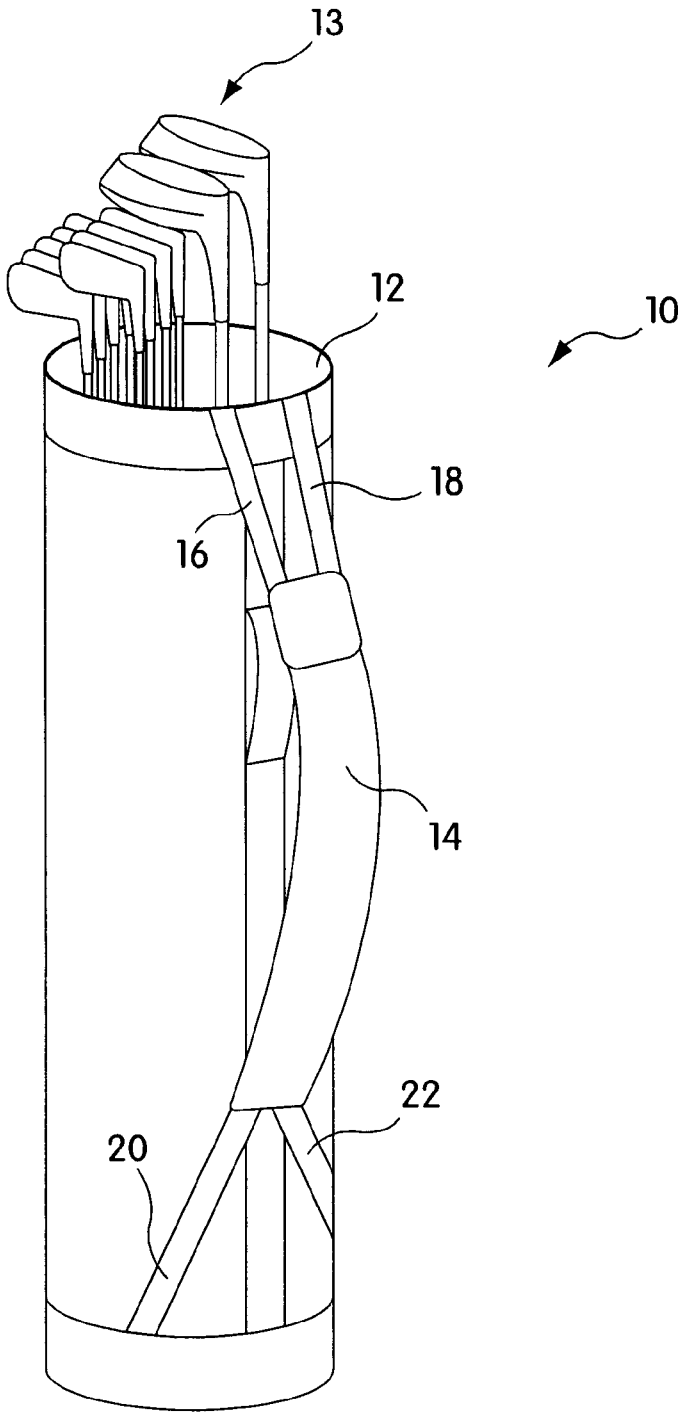
FIG. 1 is an illustration of a typical golf bag.
Figure 2:
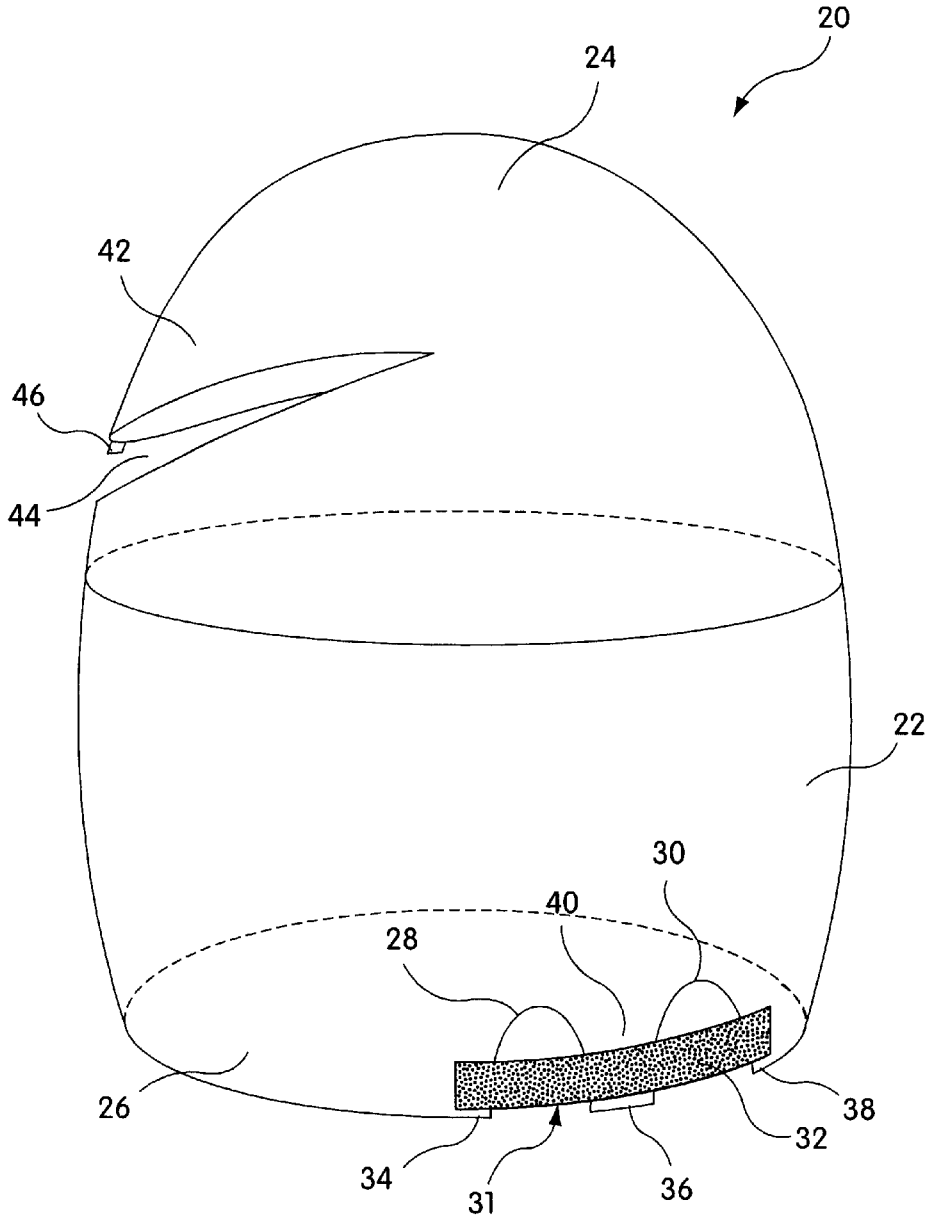
FIG. 2 is an illustration of a golf bag cover in accordance with a first embodiment of the present invention.
Figure 3:
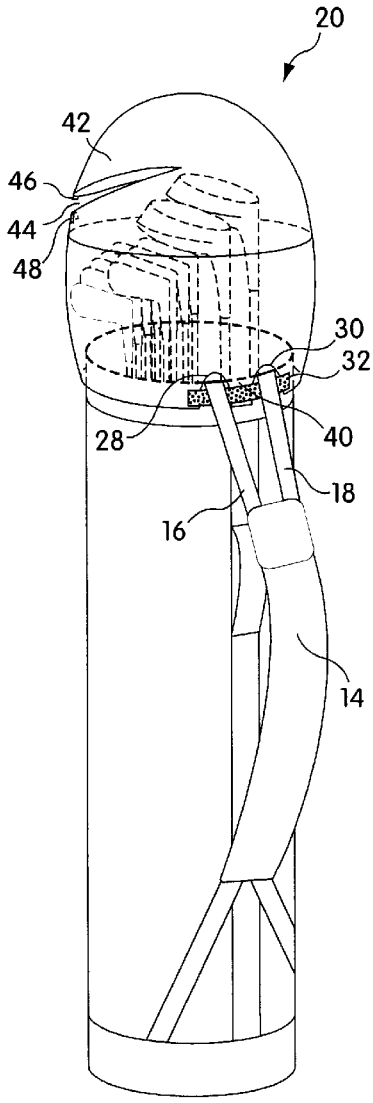
FIG. 3 is an illustration showing a perspective view of the golf bag cover of FIG. 2 installed on the golf bag of FIG. 1.

One embodiment of a golf bag cover 20 for use with the golf bag 10 of FIG. 1 will now be described with reference to FIGS. 2–5. The golf bag cover 20 includes a hollow substantially cylindrical base portion 22 and a hollow hemispherical top portion 24. The hollow cylindrical portion has a bottom opening 26 that is slightly larger than the open top portion of the golf bag 10 to allow the cover to be placed over the top of the golf bag. The hollow cylindrical portion includes two U-shaped openings 28 and 30 and a latching mechanism 31. The U-shaped openings allow the golf bag cover to properly fit around the two upper strap segments 16 and 18, and the latching mechanism 31 is used to secure the golf bag cover to the golf bag around the upper strap segments.

The latching mechanism includes a strap 32 that attaches to the golf bag cover at three attachment points 34, 36 and 38. In one embodiment, the strap 32 is secured to the golf bag cover at the three attachment points 34, 36 and 38 using a Velcro® attachment mechanism. In other embodiments, other removable attachment mechanisms such as snaps, hooks or buttons may be used to secure the strap to the three attachment points. Further, the strap 32 may be permanently attached to the golf bag cover at one of the three attachment points to prevent the strap from being misplaced. In another embodiment, the strap 32 is coupled to a draw string or cord that extends around the circumference of the bottom opening of the golf bag cover. In this embodiment, when the strap 32 is attached to the attachment points, the draw string is pulled tight around the golf bag to secure the golf bag cover to the golf bag.

Figure 5:
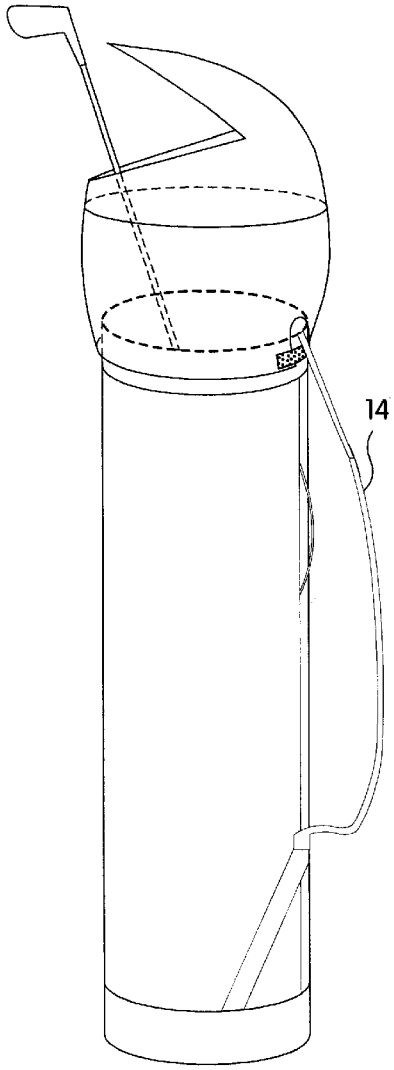
FIG. 5 is an illustration showing a side view of the golf bag cover and golf bag of FIG. 3 with the golf bag cover in the open position with a golf club being removed from the golf bag.

In the embodiment of the golf bag cover 20 shown in FIGS. 5, a portion 40 of the golf bag cover that extends between the two upper straps 16 and 18 of the golf bag is an integral part of the golf bag cover. In other embodiments of the invention, portion 40 may be a removable strap coupled to the golf bag cover using an attachment mechanism similar to that used for attaching the strap 32 to attachment points 34, 36 and 38.

When the golf bag cover 20 is installed on a golf bag, the strap 32 is initially detached from at least two of the attachment points 34, 36 and 38 to allow the strap 32 to be placed under the upper attachment straps 16 and 18 of the golf bag. The strap 32 is then attached to the golf bag cover at all three of the attachment points to secure the cover 20 to the bag 10. In contrast with the prior art devices discussed above, the golf bag cover in accordance with embodiments of the present invention allows the tipper attachment straps to fully extend out of the cover to permit the bag to be carried using the strap 14 in its intended manner.

Figure 4:
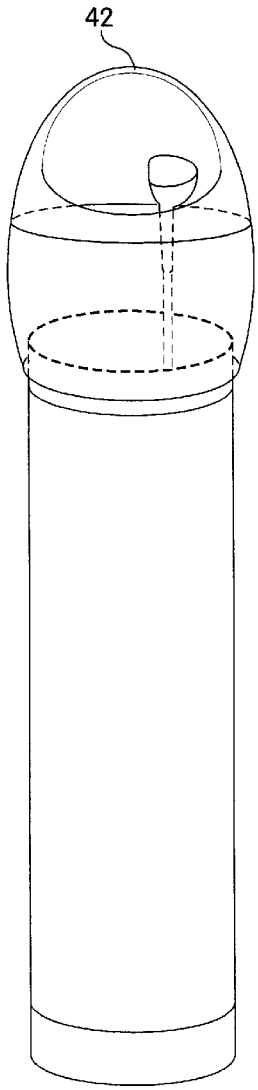
FIG. 4 is an illustration showing a front view of the golf bag cover and golf bag of FIG. 3 with the golf bag cover in an open position to allow removal of a golf club from the golf bag.

The hemispherical top portion 24 of the golf bag cover 20 includes a flap portion 42 that is formed in the top portion 24 by a slit 44. The flap portion 42 includes a tab 46 that extends beyond the slit 44. In some embodiments of the present invention, the tab 44 includes a securing mechanism for securing the tab to an attachment point 48 on the golf bag cover to fully close the flap portion 42. The securing mechanism used for securing the tab to the attachment point 48 may be similar to the mechanism used to secure the strap 32 to attachment points 34, 36 and 38. The flap portion 42 can be lifted as shown in FIGS. 4 and 5 to allow a golf club to be removed from the golf bag without removing the golf bag cover. In the closed position, the flap prevents rain from entering the golf bag.

In other embodiments of the golf bag cover, instead of using a flap, a zippered seam or some similar mechanism may be used to permit golf clubs to be removed from the golf bag without removing the golf bag cover from the golf bag. The zippered seam may extend the entire length of the golf bag cover.

Although described above as having two separate sections, embodiments of the golf bag cover 20 may be made from one continuous piece of material with appropriate folds and seams to create the cylindrical portion and the hemispherical portion. It is preferred that the material used to manufacture the golf bag cover be a substantially waterproof material such as plastic, polyester or canvas.

Embodiments of the present invention overcome drawbacks of the prior art discussed above. Specifically, embodiments of the present invention provide a cover for a golf bag that is suitable for use with golf bags having shoulder straps with four point attachment systems. Further, golf bag covers in accordance with embodiments of the present invention allow removal of a golf club from a golf bag without removal of the golf bag cover from the golf bag. In addition, golf bag covers in accordance with embodiments of the present invention, when not in use, may be easily folded or compressed to occupy a small volume to allow easy storage within the golf bag.

Having thus described at least one illustrative embodiment of the invention, various alterations, modifications and improvements will readily occur to those skilled in the art. Such alterations, modifications and improvements are intended to be within the scope and spirit of the invention. Accordingly, the foregoing description is by way of example only. It is not intended as limiting. The invention's limit is defined only in the following claims and the equivalence thereto.

What is claimed is:

1. A cover for a golfbag having a strap with strap sections for attaching to the golf bag at two attachment points of the golf bag, the cover comprising:

a housing having a top opening and a bottom opening, the bottom opening being constructed and arranged for mating with a top portion of the golf bag, the housing having a portion for extending between the strap sections of the golf bag, the portion defining two openings in the housing for receiving the strap sections of the golf bag;

a top section covering the top opening of the housing;

an attaching mechanism, mounted on the housing, that is constructed and arranged to secure the cover around the strap sections of the golf bag, the attaching mechanism including a strip that is extendible across the two openings in the housing to secure the cover around the strap sections;

wherein the strip of the attaching mechanism has a coupling mechanism for removably attaching a middle portion of the step to the portion of the housing that extends between the steep sections of the golf bag.

2. The cover of claim 1, wherein the top section includes a flap that is movable between an open position and a closed position, wherein in the open position, an opening is formed in the top section to enable a golf club to be removed from the golf bag when the cover is placed on the golf bag, and wherein in the closed position, the flap forms a seal over the opening.

3. The cover of claim 2, further comprising a tab coupled to the top section to secure the flap to the cover in the closed portion of the flap.

4. The cover of claim 1, wherein the housing and the top section are made from a substantially waterproof material.

5. The cover of claim 1, wherein the housing is substantially cylindrical.

6. A cover for a golf bag having a strap with strap sections for attaching to the golf bag at two attachment points near the top opening of the golf bag, the cover comprising:

a housing having a top opening and a bottom opening, the bottom opening being constructed and arranged for mating with a top portion of the golf bag, the housing having a portion for extending between the strap sections of the golf bag, the portion defining two openings in the housing for receiving the strap sections of the golf bag;

a top section covering the top opening of the housing;

an attaching mechanism, mounted on the housing, that is constructed and arranged to secure the cover around the strap sections of the golf bag, the attaching mechanism including a strip that is extendible across the two openings in the housing to secure the cover around the strap sections;

wherein the strip of the attaching mechanism has a first coupling mechanism to removably couple the strip to a first attachment point on the housing, and the strip of the attaching mechanism has a second coupling mechanism to removably couple the strip to a second attachment point in the housing.

7. The cover of claim 6, wherein the top section includes a flap that is movable between an open position and a closed position, wherein in the open position, an opening is formed in the top section to enable a golf club to be removed from the golf bag when the cover is placed on the golf bag, and wherein in the closed position, the flap forms a seal over the opening.

8. The cover of claim 7, further comprising a tab coupled to the top section to secure the flap to the cover in the closed portion of the flap.

9. The cover of claim 6, wherein the housing and the top section are made from a substantially waterproof material.

10. The cover of claim 6, wherein the housing is substantially cylindrical.

* * * * *

UNITED STATES PATENT AND TRADEMARK OFFICE

CERTIFICATE OF CORRECTION

PATENT NO. : 6,273,158 B1
DATED : August 14, 2001
INVENTOR(S) : Raymond P. Sharpe It is certified that error appears in the above-identified patent and that said Letters Patent is hereby corrected as shown below:

Column 4, claim 1,
Line 45, delete "step" and insert -- strip --;
Line 46, delete "steep" and insert -- strap --.

Signed and Sealed this

Sixteenth Day of April, 2002

*Attest:*

*Attesting Officer*

JAMES E. ROGAN
*Director of the United States Patent and Trademark Office*